US010765281B2

(12) United States Patent
Grey et al.

(10) Patent No.: US 10,765,281 B2
(45) Date of Patent: Sep. 8, 2020

(54) SUCTION HEAD FOR A VACUUM CLEANER AND METHOD OF OPERATION

(71) Applicant: GREY TECHNOLOGY LIMITED, Warndon, Worcestershire (GB)

(72) Inventors: Nicholas Gerald Grey, Warndon (GB); Matthew James Isted, Warndon (GB); Andrew John Kent, Warndon (GB)

( * ) Notice: Subject to any disclaimer, the term of this patent is extended or adjusted under 35 U.S.C. 154(b) by 178 days.

(21) Appl. No.: 16/074,428

(22) PCT Filed: Feb. 27, 2017

(86) PCT No.: PCT/GB2017/050528

§ 371 (c)(1),
(2) Date: Jul. 31, 2018

(87) PCT Pub. No.: WO2017/144922

PCT Pub. Date: Aug. 31, 2017

(65) Prior Publication Data

US 2019/0029482 A1 Jan. 31, 2019

(30) Foreign Application Priority Data

Feb. 25, 2016 (GB) ..... 1603300.3

(51) Int. Cl.
*A47L 9/06* (2006.01)
*A47L 9/04* (2006.01)
*A47L 9/28* (2006.01)

(52) U.S. Cl.
CPC ..... *A47L 9/066* (2013.01); *A47L 9/04* (2013.01); *A47L 9/0477* (2013.01); *A47L 9/0666* (2013.01); *A47L 9/2884* (2013.01)

(58) Field of Classification Search
CPC ..... A47L 9/04; A47L 9/0477; A47L 9/066; A47L 9/0666; A47L 9/2884
See application file for complete search history.

(56) References Cited

U.S. PATENT DOCUMENTS 2,867,833 A 1/1959 Duff
4,905,342 A 3/1990 Ataka
(Continued)

FOREIGN PATENT DOCUMENTS

DE 102015116074 A1 3/2016
EP 1136029 A2 9/2001
(Continued)

OTHER PUBLICATIONS

PCT International Search Report, PCT/GB2017/052867, Applicant: Grey Technology Limited, dated Feb. 1, 2018.
(Continued)

*Primary Examiner* — Marc Carlson
(74) *Attorney, Agent, or Firm* — Pedersen & Company, PLLC; Ken J. Pedersen; Barbara S. Pedersen

(57) ABSTRACT

This invention relates to a suction head (10) for a vacuum cleaner and method of operation. The suction head (10) has a bottom surface (26) and one or more floor-engaging parts (36) adjacent to the bottom surface (26), an opening (24) in the bottom surface (26) and a rotatable brush (30) located at the opening (24). The suction head (10) has a front end (16) and a rear end (18), the front end (16) having a recess (22) in communication with the opening (24). A movable strip (42) is located in the recess (22), the movable strip (42) being movable between a first position and a second position, the bottom edge of the movable strip 4(2) being closer to the plane of the floor-engaging parts (36) in its first position than in its second position. At least one first element (54) is connected to the movable strip (42) and is able to project to the plane of the floor-engaging parts (36). At least one second element (56) is also connected to the movable strip (42), the second element(s) (56) being configured differently to the first element(s) (54), the second element(s) (56) being able to project to the plane of the floor-engaging
(Continued)

parts (36) and being configured to move the movable strip (42) to a third position in use. The bottom edge of the movable strip (42) is closer to the plane of the floor-engaging parts (36) in its second position than in its third position. According to the method of operation, the movable strip (42) moves to its first position during backwards movement of the suction head (10) and to its third position during forwards movement of the suction head (10), the movable strip (42) moving to its third position in two stages.

22 Claims, 5 Drawing Sheets

(56) References Cited

U.S. PATENT DOCUMENTS

| | | | |
|---|---|---|---|
| 4,924,548 | A | 5/1990 | Touya et al. |
| 5,590,439 | A | 1/1997 | Alazet |
| 6,009,594 | A | 1/2000 | Grey |
| 6,055,701 | A | 5/2000 | Grey et al. |
| 6,101,668 | A | 8/2000 | Grey |
| 6,243,912 | B1 | 6/2001 | Grey |
| 6,949,130 | B1 | 9/2005 | Grey et al. |
| 6,968,587 | B2 | 11/2005 | Grey |
| 7,013,521 | B2 | 3/2006 | Grey |
| 7,017,221 | B1 | 3/2006 | Grey et al. |
| 7,117,556 | B2 | 10/2006 | Grey |
| D554,814 | S | 11/2007 | Grey |
| 7,331,078 | B2 | 2/2008 | Grey |
| 7,334,284 | B2 | 2/2008 | Grey |
| D568,008 | S | 4/2008 | Grey |
| 7,802,343 | B2 | 9/2010 | Grey |
| D694,481 | S | 11/2013 | Grey et al. |
| 9,560,944 | B2 | 2/2017 | Grey |
| 9,737,183 | B2 | 8/2017 | Grey |
| 9,943,199 | B2 | 8/2018 | Grey et al. |
| 2002/0148070 | A1 | 10/2002 | Tsuchiya et al. |
| 2004/0074027 | A1 | 4/2004 | Grey |
| 2005/0138764 | A1 | 6/2005 | Grey |
| 2005/0204492 | A1 | 9/2005 | Grey |
| 2006/0000040 | A1 | 1/2006 | Grey et al. |
| 2007/0022563 | A1 | 2/2007 | Wu |
| 2007/0143954 | A1 * | 6/2007 | Graham ..... A47L 9/0666 15/364 |
| 2008/0022485 | A1 | 1/2008 | Grey |
| 2008/0301901 | A1 * | 12/2008 | Oh ..... A47L 9/0666 15/387 |
| 2009/0300873 | A1 | 12/2009 | Grey |
| 2013/0145577 | A1 * | 6/2013 | Davidshofer ..... A47L 9/02 15/383 |
| 2014/0033473 | A1 | 2/2014 | Mcvey |
| 2016/0088987 | A1 | 3/2016 | Hwang et al. |
| 2019/0029482 | A1 | 1/2019 | Grey et al. |

FOREIGN PATENT DOCUMENTS

| | | | | |
|---|---|---|---|---|
| EP | 1955631 | A1 | 8/2008 | |
| EP | 1980188 | A2 | 10/2008 | |
| GB | 2427351 | A | 12/2006 | |
| JP | 08228975 | A * | 9/1996 | |
| JP | H08228975 | A | 9/1996 | |
| JP | 11239551 | A * | 9/1999 | |
| JP | H11239551 | A | 9/1999 | |
| JP | 2011120956 | A | 6/2011 | |
| WO | 2005/053496 | A1 | 6/2005 | |
| WO | WO-2005053496 | A1 * | 6/2005 | ..... A47L 5/30 |
| WO | 2012/085567 | A1 | 6/2012 | |
| WO | 2017/144918 | A1 | 8/2017 | |
| WO | 2017/144922 | A1 | 8/2017 | |
| WO | WO-2017188638 | A1 * | 11/2017 | ..... A47L 9/0653 |

OTHER PUBLICATIONS

PCT International Preliminary Report on Patentability, PCT/GB2017/052867, Applicant: Grey Technology Limited, Date of completion: Oct. 1, 2018.

PCT International Search Report, PCT/GB2017/050509, dated Jun. 21, 2017, Applicant: Grey Technology Limited.

PCT International Search Report, PCT/GB2017/050528, dated Jul. 31, 2017, Applicant: Grey Technology Limited.

* cited by examiner

SUCTION HEAD FOR A VACUUM CLEANER AND METHOD OF OPERATION

FIELD OF THE INVENTION

This invention relates to a suction head for a vacuum cleaner and method of operation. The invention is expected to have its greatest utility in relation to a battery-powered vacuum cleaner, but it is not limited to such applications.

In the following description, directional and orientational terms such as "top", "bottom" etc. refer to the suction head in its normal orientation of use upon a substantially horizontal surface, as represented in FIG. 1. It will be understood, however, that the vacuum cleaner can be used in other orientations. Also, terms such as "forwards" and "backwards" are to be understood as referring to movements of the suction head across a (substantially horizontal) surface, the front end of the suction head leading in the forwards direction and the rear end of the suction head leading in the backwards direction.

BACKGROUND TO THE INVENTION

Vacuum cleaners have a motor which typically drives an impeller to create a flow of air. The suction head of the vacuum cleaner has an opening in its bottom wall through which air can enter, the air carrying dirt and debris into the suction head. It is arranged that the air transports the dirt and debris by way of one or more airflow ducts within the suction head. The dirt and debris is transported through the duct(s) to a dirt-collection chamber. The air then passes through one or more filters before leaving the vacuum cleaner, the filters being arranged to trap the dirt and debris within the dirt-collection chamber for subsequent disposal.

The dirt-collection chamber can contain or comprise a disposable bag, the wall of the bag also acting as a filter. Alternatively, the dirt-collection chamber is a receptacle which can be removed from the vacuum cleaner, emptied, and re-installed into the vacuum cleaner for re-use.

Many vacuum cleaners have a rotatable brush located adjacent to the opening of the suction head. The brush is rotated and engages the surface which is being cleaned. The brush helps to dislodge dirt and debris from the surface which is then entrained in the air flow and transported to the dirt-collection chamber.

Many vacuum cleaners are mains powered, and the manufacturers of mains powered vacuum cleaners will often seek to maximise the electrical and suction power of their vacuum cleaners in an attempt to increase their marketability. Typically, the opening of the suction head is surrounded by a wall. The air is forced to pass underneath the wall and through the underlying carpet or the like whereby to dislodge dirt and debris from between the fibres of the carpet. As impellers are typically 10 to 40% efficient in use this is a relatively inefficient method of cleaning. In order to achieve higher impeller efficiencies, manufacturers have tended to develop faster spinning impellers creating higher suction. However, as it is air flow rather than suction which dislodges dirt and debris, such vacuum cleaners generally do not achieve improved dirt and debris collection efficiency. Manufacturers have therefore tended to quote electrical and suction power as an indicator of the effectiveness of their appliances rather than cleaning efficiency.

It is also known to provide battery-powered vacuum cleaners. Battery-powered vacuum cleaners employing this traditional approach cannot provide the suction power of a mains-powered vacuum cleaner without prejudicing the operating cycle of the vacuum cleaner, i.e. without unacceptably shortening the period between battery recharging, and therefore do not provide comparable cleaning performance.

Most domestic mains-powered vacuum cleaners fall into two broad classes. The first class is often referred to as cylinder vacuum cleaners. In cylinder vacuum cleaners the suction head is connected to an operating handle which in turn is connected to a flexible hose through which the dirt and debris pass on their way to the dirt-collection chamber. The dirt-collection chamber is located within a body which is separate from the suction head and which also contains the motor, the body having wheels or slides by which it may be pulled across the floor during the cleaning operation.

The second class is often referred to as upright vacuum cleaners. In upright vacuum cleaners the motor and dirt-collection chamber are carried by, or in some cases are integral with, the operating handle, so that the body containing the motor and the dirt-collection chamber typically lie above the suction head during the cleaning operation.

Battery-powered vacuum cleaners may adopt a somewhat different approach with the battery, motor, impeller and dirt-collection chamber all located in the suction head. The operating handle connected to the suction head is therefore used solely for maneuvering the suction head across the floor being cleaned.

Vacuum cleaner performance can vary considerably according to the surface being cleaned and the type of debris encountered. To collect larger debris the leading edge of the suction head should allow the debris to pass underneath and into the region of the opening. In contrast, in order to remove fine dirt and dust from floor crevices it is desirable to have all edges of the suction head seal to the surface being cleaned so that the airflow enters by way of the crevices, removing dust and debris as it flow therethrough.

Because battery-powered vacuum cleaners are more limited than mains-powered vacuum cleaners in the power of the motor they can employ, and are also limited in the capacity of the batteries they can utilise, they may employ other means to improve cleaning efficiency. A flexible cleaning strip is disclosed in GB patent 2 389 306 in relation to a battery-powered sweeper, although the cleaning strip could be adapted to a vacuum cleaner. The cleaning strip is located behind the opening in the suction head and can adopt a lowered position during forwards movement of the suction head, and a raised position during backwards movement of the suction head. During forwards movement the cleaning strip lies against the surface being cleaned and prevents fine dust passing underneath the trailing edge and being left behind. During backwards movement the cleaning strip is lifted away from the surface allowing fine dust and dirt to pass under the strip and into the region of the opening.

The suction head of the cylinder vacuum cleaner of U.S. Pat. No. 5,101,534 employs a flexible strip adjacent to the front of the suction head, the strip being deformed by the airflow to vary the gap between the front end of the suction head and the surface being cleaned.

The suction head of WO 97/15224 has two cleaning strips, one in front and one behind the opening in the suction head. A rocker mechanism is provided so that when the suction head is moving forwards the front cleaning strip is raised, whereas when the suction head is moving backwards the rear cleaning strip is raised. In each case a raised cleaning strip allows dirt and debris to pass under the cleaning strip into the region of the opening.

U.S. Pat. No. 5,101,534 also shows a bumper in the form of a resilient strip which surrounds the suction head and reduces the likelihood of impact damage to the suction head and to other articles. In common with many vacuum cleaner suction heads, at the front end of the suction head the bumper lies above a recess which communicates with the suction opening. The recess allows the suction head to pass over relatively large pieces of dirt and debris so that those pieces pass into the region of the opening where they can be lifted (by the rotating brush and/or the airflow) into the suction head.

SUMMARY OF THE INVENTION

The inventor has conceived improvements to the suction head for a vacuum cleaner, directed primarily at enhancing the cleaning efficiency of the vacuum cleaner.

According to the first aspect of the present invention there is provided a suction head for a vacuum cleaner, the suction head having an opening in its bottom surface and a rotatable brush located at the opening, the suction head having a front end and a rear end, the bottom edge of the front end having a recess in communication with the opening, the front end carrying a resilient member, a part of the resilient member being located above the recess, characterised in that further parts of the resilient member lie to opposed sides of the recess.

The resilient member is continuous and at least partially surrounds the recess and acts primarily as a sealing element. When the front end of the suction head engages a wall, stair riser or the like, the resilient member acts to restrict the area through which air can flow into the suction head, and in particular causes the majority of air to flow into the suction head very close to the surface being cleaned. Alternatively stated, the resilient member reduces or eliminates the air flow into the top and sides of the recess.

By restricting the area of the airflow through the recess, the resilient member increases the speed of the airflow through the recess. Also, the resilient member restricts the airflow to areas very close to the surface being cleaned (i.e. very close to the bottom of the wall or the like), thereby increasing the likelihood that dirt and debris lying at the bottom of the wall will be dislodged by the airflow. This is a particular benefit for a battery-powered vacuum cleaner in particular because dirt and debris adjacent to the bottom of a wall (or the like) cannot usually be engaged by the rotating brush and must be collected by the airflow. Increasing the effectiveness of the airflow in entraining dirt and debris has a significant effect upon the cleaning efficiency of the vacuum cleaner.

Accordingly, the primary (or only) function of the resilient member is to provide a substantial seal against a vertical surface such as a wall or stair riser. This is contrary to the function of a conventional bumper which is impact resistance. The material of the resilient member is therefore chosen primarily (or only) for its sealing capabilities. Preferably, however, the resilient member functions also as a bumper, in which case the material is chosen secondly for its impact resistance.

The recess may be at least partially occupied by a movable strip or the like, so that the airflow through the recess is further controlled.

According to the second aspect of the present invention there is provided a suction head for a vacuum cleaner, the suction head having a bottom surface and one or more floor-engaging parts adjacent to the bottom surface, an opening in the bottom surface and a rotatable brush located at the opening, the suction head having a front end and a rear end, the front end having a recess in communication with the opening, a movable strip located in the recess, the movable strip being movable between a first position and a second position, the bottom edge of the movable strip being closer to the plane of the floor-engaging parts in its first position than in its second position, at least one first element connected to the movable strip, the first element(s) being able to project to the plane of the floor-engaging parts whereby to control the movement of the movable strip between its first and second positions in use, a second element also connected to the movable strip, the first element and the second element being differently configured, the second element being able to project to the plane of the floor-engaging parts and being adapted to move the movable strip to a third position, the bottom edge of the movable strip being closer to the plane of the floor-engaging parts in its second position than in its third position.

The cleaning strip of GB 2 389 306 has multiple elements (or tabs) which are similarly configured and operate together to lift the cleaning strip in a single-stage operation between its first and second operational positions. The inventors have discovered that whilst a cleaning strip such as that of GB patent 2 389 306 can be fitted at the front end of the suction head, it does not provide significant benefits in terms of cleaning performance for large debris. In particular, the inventors have found that the elements fitted to the cleaning strip of GB 2 389 306 do not lift the cleaning strip far enough from the surface being cleaned to provide a significant benefit in terms of cleaning performance for large debris. In order to have a significant benefit in terms of cleaning performance, and in particular in order to allow relatively large pieces of dirt and debris to pass through the recess, it is necessary that the cleaning strip be raised several millimetres further from the surface than is possible with practical embodiments of the cleaning strip of GB patent 2 389 306.

The inventors have further discovered that the cleaning strip of GB 2 389 306 cannot be modified to provide the required movement without causing unacceptable problems. For example, if the elements or tabs are modified so as to protrude sufficiently far from the strip in order to raise the strip sufficiently to clear large objects, the elements become too long to operate correctly and instead tend to push along rubbing against the floor rather than lifting the cleaning strip.

The present aspect of the invention provides second elements which are differently configured to the first elements and which act to lift the cleaning strip to a third position in which its bottom edge is raised beyond the second position. There is therefore a "two-stage" process, with the first element primarily controlling the movement of the movable strip to its second (or intermediate) position, and the second element primarily controlling the movement of the movable strip to its third (fully raised) position. The word "primarily" is used since in practice there is some overlap between the first and second elements, with both elements together controlling some parts of the movement of the movable strip.

In common with known suctions heads the floor-engaging parts can be one or more wheels and/or one or more slides. In use upon a hard surface the wheels and/or slides will rest upon the surface so that the plane of the floor-engaging parts corresponds to the hard surface. In use upon a soft (e.g. carpeted) surface the wheels and/or slides will dig into the surface somewhat. In both cases, it is arranged that the first and second elements engage the floor surface during use so that the position of the movable strip is controlled by the interaction of the first and second elements with the floor surface.

Various other solutions utilising a friction means connected to a mechanism to lift the strip can be envisaged, but the application is subject to a surprisingly harsh environment and more complex mechanisms quickly break down when repeatedly run over threshold strips or uneven flooring.

Providing first and second elements which are differently configured and which can provide a two-stage movement of the strip has been found to enable the movement required without consequential problems. When the suction head is moved forwards the first element (or array of elements) flip over by means of friction with the floor and cause the movable strip to move to the second position. That movement preferably causes the second element (or array of elements) to move downwards to increase their friction with the floor. As the suction head continues to move forwards the second element(s) flip and increase the distance by which the movable strip is lifted from the surface, in particular giving sufficient lift to enable large objects to pass under the strip and be collected.

Also, because the first and second elements operate sequentially they provide an effective solution without occupying a large amount of space and without mechanical complication. This is a particular benefit in all suction heads as space at the front end of the suction head is usually limited, but is especially beneficial for the suction head of a battery-powered vacuum cleaner.

Preferably, the first and second elements project below the bottom edge of the movable strip. This permits the movable strip to lie above the plane of the floor-engaging parts and reduces wear upon the movable strip during use. There can therefore be a small gap between the bottom edge of the movable strip and the floor surface when the movable strip it is its first position, a small gap encouraging rapid air flow underneath the movable strip.

Ideally, the first and second elements project below the bottom edge of the movable strip by the same distance.

Preferably, the first element is oriented at a first angle relative to the strip, and the second element is oriented at a second angle relative to the strip, the first angle being less than the second angle. Ideally the first angle is less than 10°, and is desirably around 0°. Ideally the second angle is less than 45°, and is desirably between around 20° and 40°, and most desirably around 30°.

It will be understood that in preferred embodiments of the invention according to the second aspect, when the suction head is moving backwards the bottom edge of the first and second elements engage the surface being cleaned and drive the movable strip to its first (lowered) position. When the suction head is subsequently moved forwards the first element initially causes the movable strip to move towards its second (intermediate) position. This movement causes the second element to be driven into greater engagement with the surface being cleaned and the second element then drives the movable strip into its third (raised) position. Preferably, the first element does not engage the surface being cleaned in the third position.

When the movable strip is in its third (raised) position relatively large objects (up to around 10 mm in some embodiments) can pass through the recess and be engaged by the rotatable brush and entrained into the airflow.

Without the second element the movable strip could realistically only be raised by around 4 mm above the surface being cleaned. Objects larger than around 4 mm would therefore be pushed along by the suction head rather than collected.

When the suction head is subsequently moved in a backwards direction the second element drives the movable strip towards its first position. At some point the first element also engages the surface being cleaned and helps to drive the movable strip to its first position.

When the movable strip is in its first position it lies very close to (and perhaps in contact with) the surface being cleaned, reducing the area through which air can flow through the recess towards the opening and thereby increasing the speed of the inflowing air (which in turn increases the likelihood that dust and fine dirt adjacent to the recess will be dislodged and entrained into the airflow).

It will therefore be understood that during normal use of the suction head in which it is moved alternatively forwards and backwards across a surface, the suction head is suited to collect larger pieces of dirt and debris on the forwards strokes, and to clean crevices of the floor on the backwards strokes.

In particularly preferred embodiments the opening is substantially surrounded, by the movable strip according to the present invention at the front end, by a flexible strip behind the opening, and by other (ideally non-movable) strips (such as lint strips) to the sides of the opening. In International Electrotechnical Commission (IEC) tests conducted by the inventor on a hard floor with crevices (namely the gaps between timber planks) the cleaning efficiency can be increased significantly, in one case from around 12% to around 104% (it being possible to achieve more than 100% efficiency by collecting dirt from outside the area covered by the suction head).

BRIEF DESCRIPTION OF THE PREFERRED EMBODIMENTS

The invention will now be described in more detail, by way of example, with reference to the accompanying drawings, in which.

DETAILED DESCRIPTION

Figure 1:
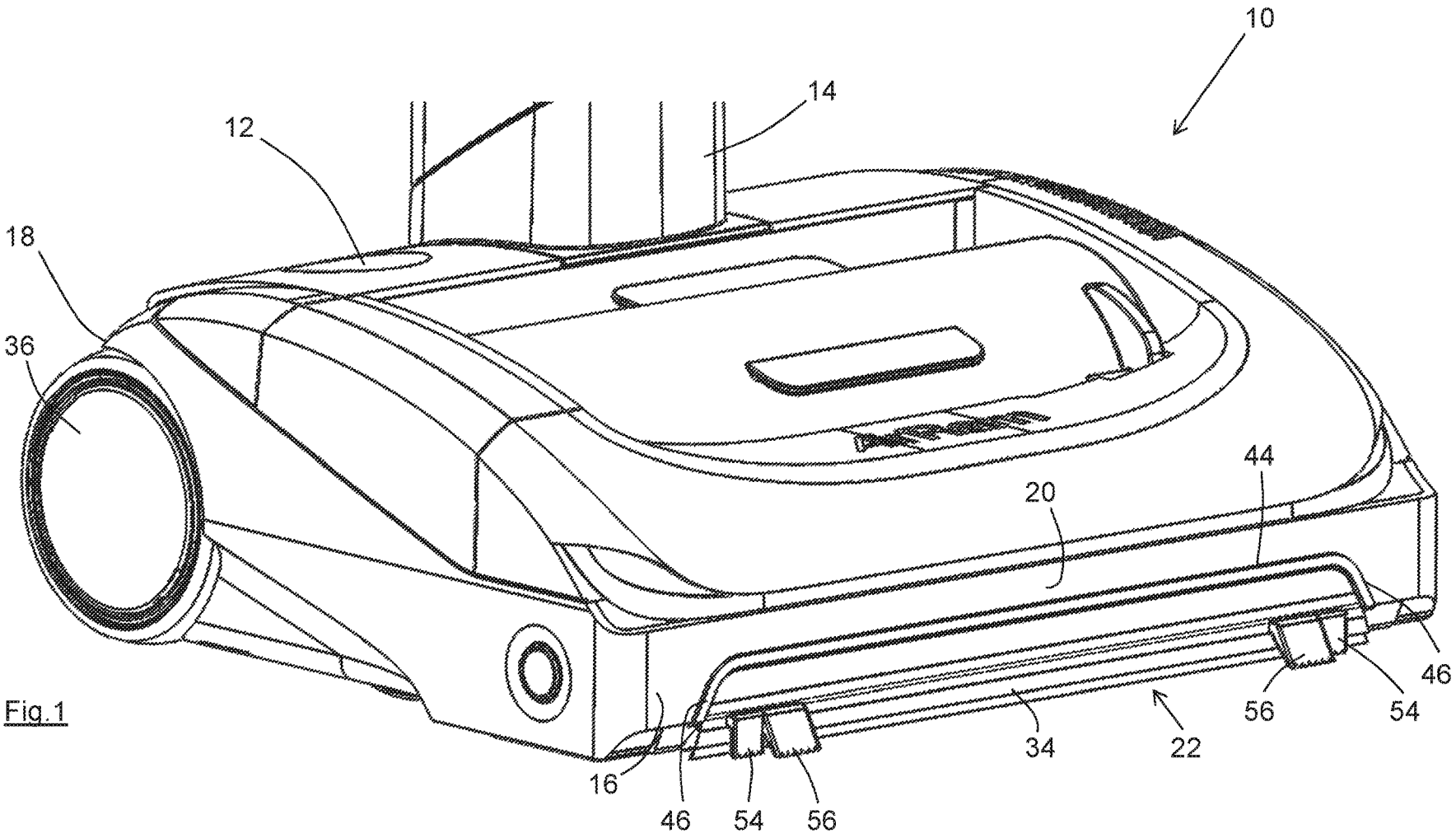
FIG. 1 shows a perspective view of a suction head according to the first and second aspects of the present invention.
Figure 2:
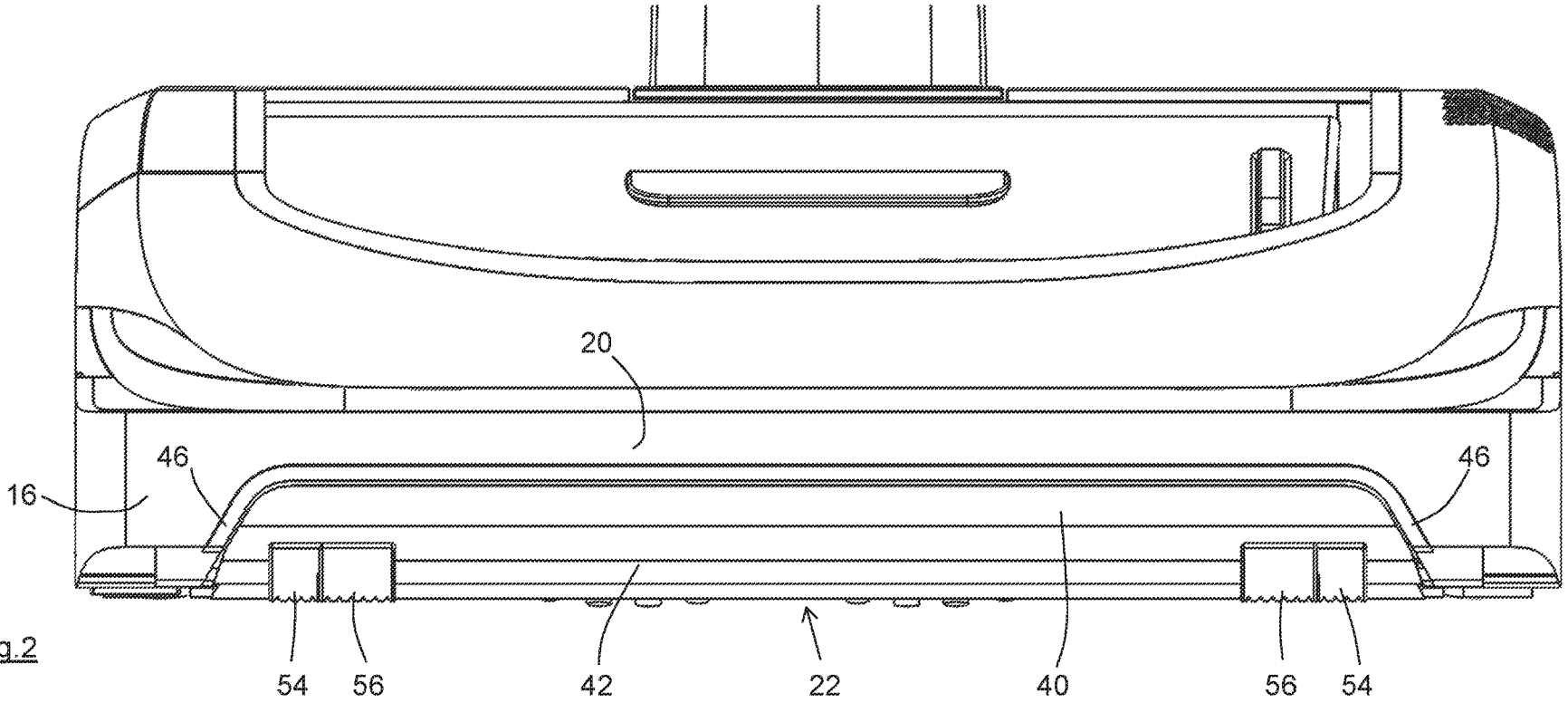
FIG. 2 is a front view of the suction head of FIG. 1.

The suction head 10 is part of a battery-powered vacuum cleaner. As such, the suction head has a battery, a motor, an impeller and a dirt-collection chamber, none of which can be seen in FIG. 1, but all of which will be readily understood by a person skilled in this art.

The suction head 10 has an on-off switch 12 and therefore carries all of the operating componentry of the vacuum cleaner. The handle 14 is used only to manoeuvre the suction head 10 across a floor or other surface being cleaned.

The present invention, according to both aspects, does not depend upon the other components of the suction head, and could if desired by used on the suction head of a mains-powered vacuum cleaner of the cylinder or upright type. The significant benefits of the present invention in terms of cleaning efficiency are most appropriate for a battery-powered vacuum cleaner, however, such as that of FIG. 1.

The suction head 10 has a front end 16 and a rear end 18. It will be understood that the suction head 10 is most usually moved across the surface being cleaned (by way of the handle 14) in a reciprocating motion, towards and away from the user, and alternately towards and away from the bottom right-hand corner of the page as viewed in FIG. 1. For the avoidance of doubt, forwards movement is herein defined as towards the bottom right-hand corner of the page in FIG. 1 (with the front end 16 leading), and backwards movement is defined as away from that corner of the page (with the rear end 18 leading).

Figure 3:
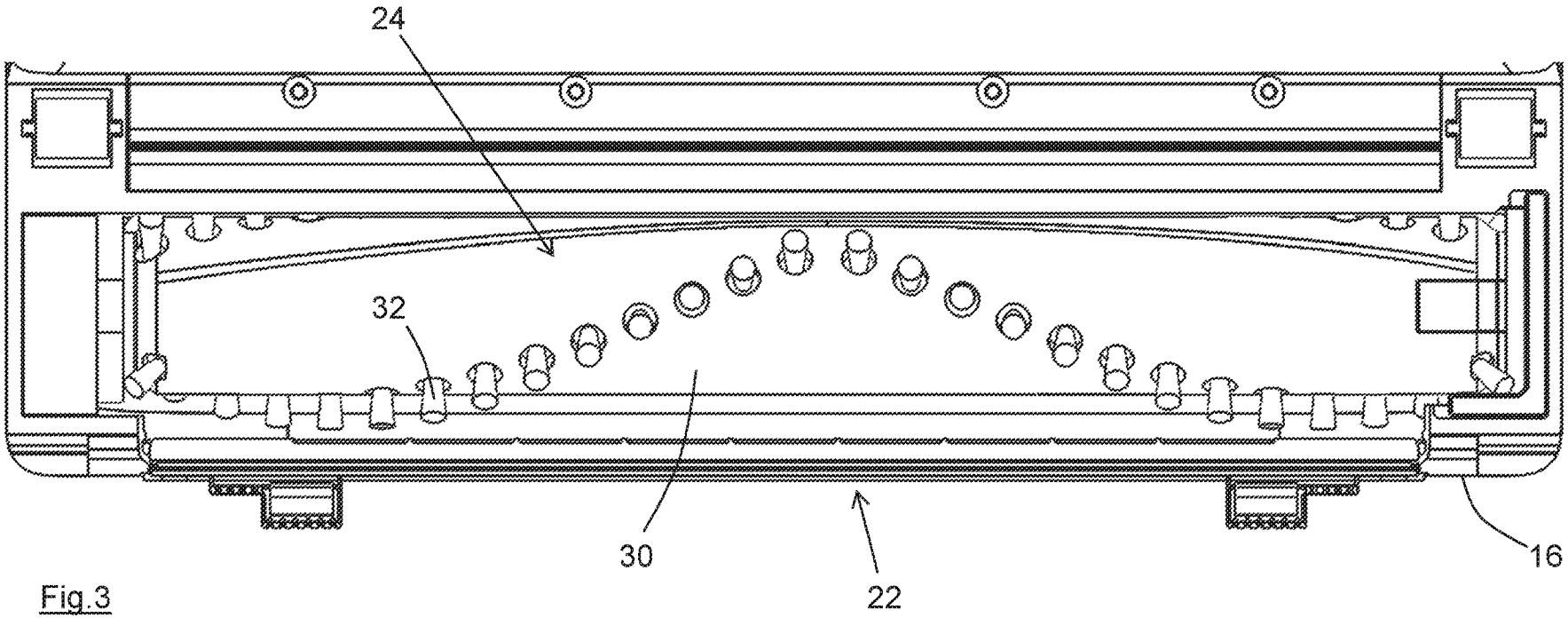
FIG. 3 is an underside view of part of the suction head of FIG. 1.

The front end 16 comprises a substantially flat and vertical surface 20, ideally of a substantially rigid plastics material. The surface 20 is connected to the sides of the suction head by rounded corners, in known fashion. The surface 20 is shaped to define a recess 22 which communicates with the opening 24 (FIG. 3) in the bottom surface 26 of the suction head 10. A rotatable brush 30 is located in the opening 24, and the projecting bristles 32 extend through the opening 24 to engage the surface being cleaned, in known fashion.

Also in known fashion, the bottom surface 26 of the suction head 10 is held above the surface being cleaned 34 (FIG. 5) by wheels 36 at its rear end and further wheels, rollers or slides (not shown) at its front end. The wheels 36 and the further wheels, rollers or slides are the floor-engaging parts of the suction head and together define a plane of the floor-engaging parts. In use upon a hard surface such as that shown in FIG. 5, the plane of the floor-engaging parts corresponds to the floor (i.e. the surface being cleaned) 34.

A gap G is therefore created between the bottom surface 26 of the suction head 10 and the floor surface 34. In use, air flows (substantially horizontally) from outside the suction head 10 through the gap G and into the opening 24. It will be understood that the floor 34 may have a covering such as carpet, in which case the gap G will be reduced by the distance by which the wheels (etc.) press into that covering.

The recess 22 cannot be seen in the figures because it is occupied, partly by a fixed strip 40 and partly by a movable strip 42, the movable strip being shown in its first (lowered) position. As explained below, however, when the movable strip 42 is moved to its third (raised) position relatively large pieces of dirt and debris can pass through the recess 22 where they can be engaged by the rotatable brush 30. The rotatable brush, or the airflow into the suction head, or both, act to lift those pieces into the suction head 10 and carry them into the dirt-collection chamber for subsequent disposal.

A continuous resilient member 44 is located on the front end 16 and projects slightly from the front end (in this embodiment by around 3 mm). The resilient member 44 is mounted to the surface 20 and in this embodiment lies close to the recess 22.

The resilient member 44 has a (substantially horizontal) part which runs across the surface 20 immediately above the recess 22, in a similar fashion to a conventional bumper used for impact protection. Importantly, however, the resilient member 44 differs in having a downwardly-extending part 46 to each side of the recess 22. The downwardly-extending parts 46 continue to the bottom edge of the surface 20 and therefore terminate close to the bottom of the suction head 10 and close to the floor 34.

In this embodiment the distance D (FIG. 5) between the bottom edge of the parts 46 of the resilient member 44 and the plane of the floor-engaging parts is 20 mm. Whilst it would be possible to continue the resilient member closer to the bottom of the suction head 10 (most appropriately by extending the flat surface 20 downwardly) that is not necessary. In particular, it is desirable to have a chamfered bottom edge of the front end 16 so that the suction head 10 can ride up over the edges of carpets, threshold strips and the like. Also, encouraging airflow through the recess 22 below the bottom edges of the parts 42 is advantageous as that airflow is very close to the surface being cleaned.

The particular benefit of the first aspect of the invention can be appreciated most clearly from FIG. 1. When the front end 16 of the suction head 10 is moved into engagement with a wall, skirting board or stair riser for example, the surface 20 will lie parallel to the wall across its full area. The whole length of the resilient member 44, including importantly the parts 46, will also engage the wall, and can form an effective seal with the wall. The entire airflow into the recess 22 (which comprises a large proportion of the airflow into the opening 24) must therefore pass around the bottom ends of the parts 46, very close to the bottom of the wall. It will be recognised that most suction heads cannot be manipulated so that the rotatable brush engages the bottom edge of the wall, and as such dirt and debris collect at the bottom edge of the wall. Encouraging a rapid flow of air adjacent to the bottom edge of the wall acts to dislodge much or all of the dirt and debris located there, and once dislodged that dirt and debris is much more likely to pass through the recess 22 and be collected by the suction head 10.

Whilst the resilient member 44 is designed primarily to provide an effective seal against a vertical wall, skirting board, stair riser and the like, in the present embodiment it functions also as impact protection. The resilient member 44 therefore avoids the requirement for a separate bumper at the front end 16.

Figure 4:
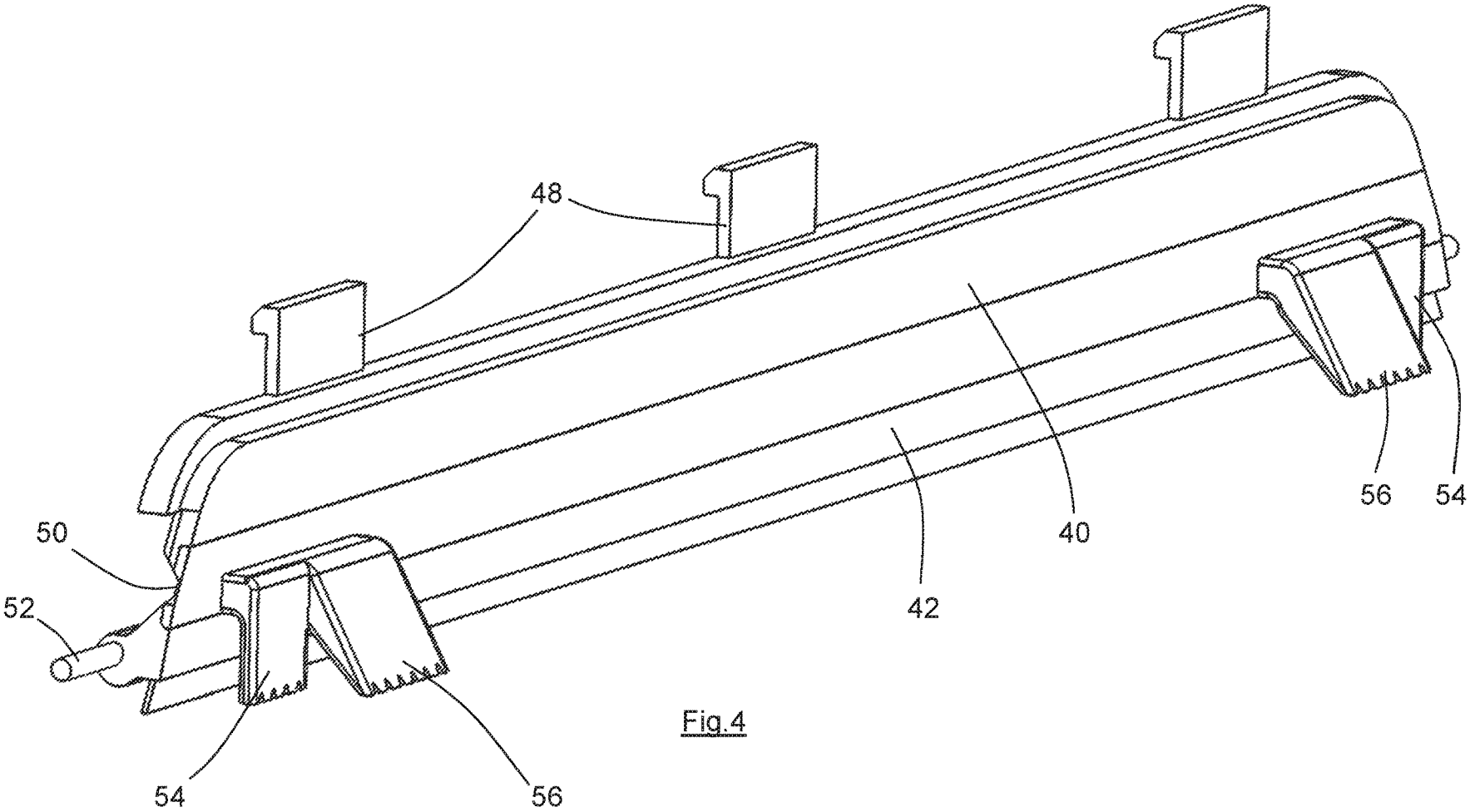
FIG. 4 is a perspective view of the movable strip and first and second elements according to the second aspect of the invention.

The drawings also show the movable strip 42 according to the second aspect of the invention. As seen in FIG. 4, the movable strip 42 and the fixed strip 40 are formed as a unitary structure carrying clips 48 by which it may be removably secured to the remainder of the suction head 10. This removable mounting allows the component 40, 42 to be replaced when worn.

Figure 5:
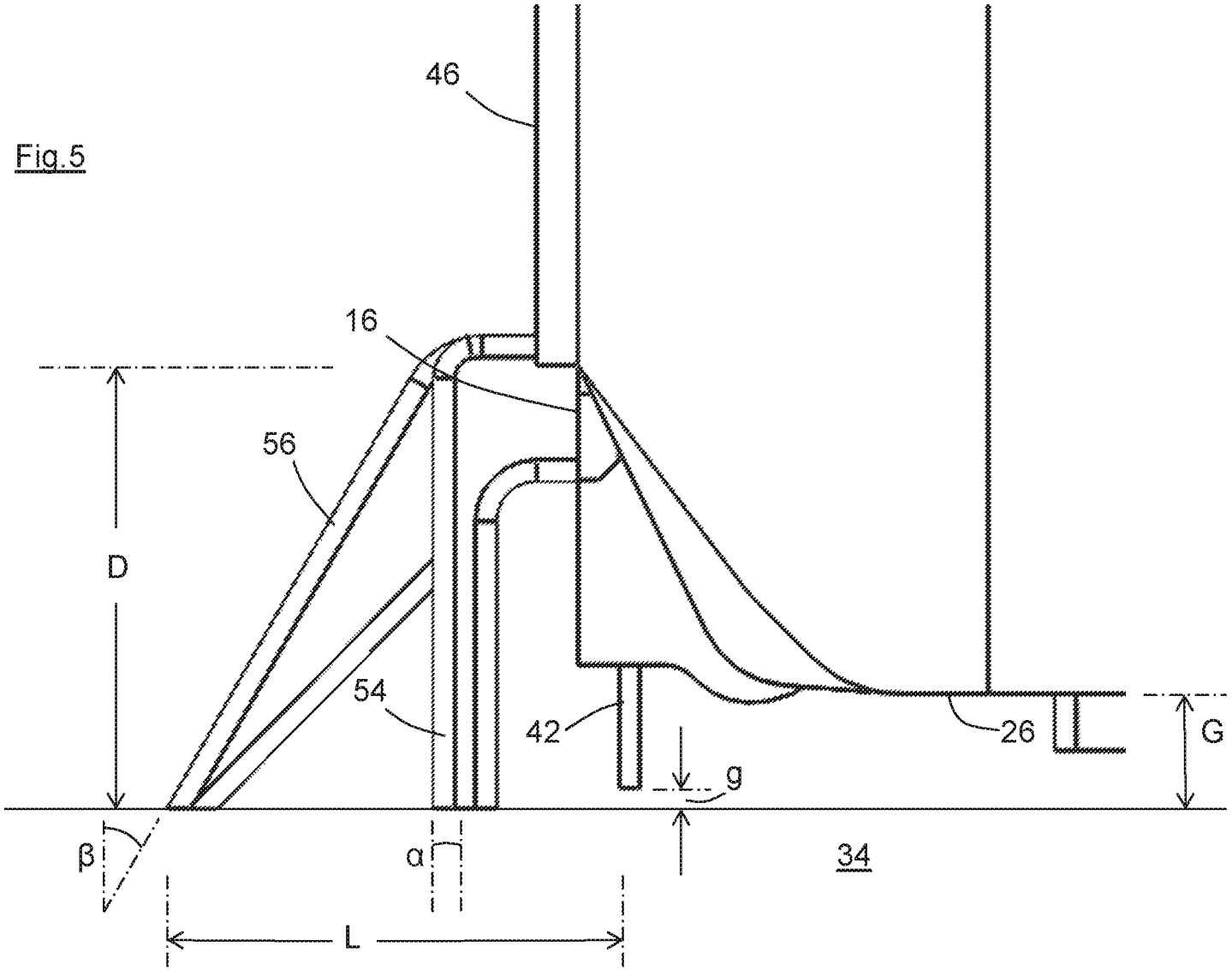
FIG. 5 is an enlarged side view of part of the suction head of FIG. 1.

The component 40, 42 has a line 50 of reduced thickness and about which the movable strip 42 pivots relative to the fixed strip 40. The movable strip 42 has a projecting stop 52 which acts to limit the forwards pivoting movement of the movable strip when the vacuum cleaner is moving backwards (FIG. 5 showing the limit of the forwards (clockwise in this view) pivoting movement).

The component 40, 42 is located in the recess 22 and when the movable strip 42 is in the first position as drawn the fixed strip 40 and the movable strip 42 together substantially fill the recess 22. As will be understood from FIG. 1, when the movable strip 42 is in this lowered position, airflow through the recess 22 is largely prevented, and air enters the opening from the front end 16 by way of the small gap g (FIG. 5) between the bottom of the movable strip 42 and the floor 34.

It can be arranged that a movable strip according to GB patent 2 389 306 is located behind the opening 24, and further strips (such as for example lint strips) are located to the sides of the opening 24, so that the area through which air must flow into the opening 24 is very restricted and the speed of that airflow is high.

The movable strip 42 carries two first elements (or tabs) 54 and two second elements (or tabs) 56. The first and second elements 54, 56 operate together, sequentially, to control the position of the movable strip, as explained below.

It will be seen from FIG. 5 in particular that both of the first and second elements 54, 56 project below the bottom edge of the movable strip 42. The additional projecting distance may be relatively small, for example 0.5 mm, but this is sufficient to ensure that the movable strip 42 does not engage the floor 34 in its lowered or raised positions and is therefore protected from undue wear, whilst the first and second elements 54, 56 can engage the floor 34.

In this embodiment both of the first and second elements 54, 56 project below the bottom edge of the movable strip 42 by the same distance but that is not necessarily the case and in other embodiments the first element can project further than the second element.

The movable strip 42 is in its first (lowered) position in FIG. 5, which is the position adopted when the suction head in moving backwards (to the right as drawn in FIG. 5), i.e. with the front end 16 trailing. In that position, the gap g between the bottom edge of the movable strip 42 and the floor 34 is minimised, ensuring that the maximum quantity of dirt or debris is dragged across the surface by the movable element 42 and maintained within the region of the opening 24. Also, the speed of the air flowing through the gap g from the front end 16 is maximised, and importantly the speed of the airflow through any crevice in the floor 34 adjacent to the opening 24 is also maximised.

Whilst it could be arranged that the gap g is zero when the movable strip 42 is in its first position (so that the bottom edges of the first elements 54, second elements 56 and movable strip 42 all lie in the same plane engaging the floor 34) that is not preferred as it would result in wear of the movable strip 42. Instead, a small gap g is preferred as shown in FIG. 5

If the direction of movement of the suction head 10 is reversed so that the front end 16 becomes the leading end, the first and second elements 54, 56 act sequentially to lift the movable strip 42. Alternatively stated, the differing configurations of the first and second elements 54, 56 provide a two-stage movement for the movable strip 42. Specifically, because in this embodiment the first and second elements 54, 56 both engage the surface 34 they both urge the movable strip to pivot anti-clockwise as viewed in FIG. 5.

The whole of the movable strip 42, including all that can be seen in FIG. 5, can pivot anti-clockwise about the fold line 50, relative to the fixed strip 40, in this embodiment by around 40°. It is arranged that the first and second elements 54, 56 are of the same material, and are substantially the same thickness. The shorter length of the first elements 54 makes them more rigid, however, and it is this greater rigidity which causes the first element 54 to assume greater control over the initial pivoting movement of the movable strip 42.

As the movable strip 42 pivots anti-clockwise as drawn in FIG. 5, it will be understood that the bottom edge of the second element 56 is driven into greater engagement with the floor 34. In this embodiment the floor 34 is a hard surface, so that the second element 56 is caused to deform by its increased engagement with the floor. In any event, the pivoting of the movable strip 42 continues (even after the bottom edge of the first element 54 is lifted away from the floor 34) as the second element is forced to rotate anti-clockwise past (or alternatively stated to flip underneath) the fixed strip 40. Stops can be provided to limit the pivoting movement of the movable strip 42, but preferably the movement can continue until the bottom edge of the second element 56 is about to leave the floor 34.

The limit of pivoting movement of the movable strip 42 defines the third or raised position of the movable strip 42. In that position there is a relatively large gap (not shown) between the bottom edge of the movable element 42 and the floor 34 through which relatively large pieces of dirt and debris can pass. In some embodiments the gap may be as large as the gap G, for example around 5 mm when fully open. It will be understood that when the movable element 42 is in its third position the speed at which air flows through the recess 22 is reduced commensurate with the increased area through which the air can flow. The suction head 10 is therefore suited to collecting larger pieces of debris on its forwards strokes, and to collecting dust and smaller pieces of dirt (particularly from within crevices in the surface being cleaned) on its backwards strokes.

When the suction head 10 is again moved backwards, the engagement of the bottom edge of the second element 56 with the floor 34 causes the movable element 42 to pivot clockwise. At some point the bottom edge of the first element 54 also engages the surface 34 and further ensures the pivoting of the movable strip 42 back to its first position.

It will be understood that the first element 54 alone could not achieve the same degree of angular movement of the movable strip 42, nor therefore the same increase in the gap g below the bottom edge of the movable strip 42 and the floor 34. Importantly, the second element 56 acting alone cannot reliably achieve that movement either and it has been found that without the first element 54 the second element 56 often simply moves across the surface 34 and does not flip underneath the fixed strip 40. Thus, tests conducted by the inventor have shown that the sequential (two-stage) operation of the first and second elements 54, 56 is necessary to achieve reliable movement of the movable strip between its first and third positions, without requiring an increased engagement with the floor 34 and thereby unacceptable wear.

In one embodiment, the first elements 54 alone can pivot the movable strip 42 to a second (intermediate) position in which the bottom edge is raised by around 4 mm. The first and second elements 54, 56 acting sequentially can, however, raise the bottom edge by around 10 mm. Attempts to provide a similar 10 mm of lift with a single element acting alone result in unreliable operation and/or unacceptable wear.

It will be understood that the maximum distance by which the movable strip 42 can be lifted is determined primarily by the distance L (FIG. 5), i.e. the distance by which the second element 56 protrudes from the movable strip 42.

In the embodiment shown the movable element 42 is substantially vertical in its first position. The first element 54 is aligned substantially vertical also, so that the angle $\alpha$ between these components is 0°. The angle $\beta$ between the second element 56 and the movable strip 42 is around 30° in this embodiment.

It will be observed from FIG. 5 that in the first position the first and second elements 54, 56 project forwardly beyond the front end 16, and in particular beyond the resilient member 44. Whilst it might be considered that the first and second elements 54, 56 would impair the ability of the resilient member 44 to seal to a vertical wall or the like that is not the case as when the suction head 10 is moved forwardly into engagement with the wall the first and second elements 54, 56 are not in the position of FIG. 5, but are pivoted anti-clockwise from that position, and do not project as far as the resilient member 44.

It will be understood that the material of the movable strip 42, and in particular the first and second elements 54, 56 should be flexible and resistant to wear. A suitable material for these components is polyurethane. One suitable material for the resilient member 44 is thermoplastic elastomer (TPE), but other rubberised materials used for the bumpers of vacuum cleaners could be used.

The invention claimed is:

1. A suction head for a vacuum cleaner, the suction head having a bottom surface and one or more floor-engaging parts adjacent to the bottom surface, an opening in the bottom surface and a rotatable brush located at the opening, the suction head having a front end and a rear end, the front end having a recess in communication with the opening, a movable strip located in the recess, the movable strip being movable between a first position and a second position, the bottom edge of the movable strip being closer to the plane of the floor-engaging parts in its first position than in its second position, at least one first element connected to the movable strip, the first element(s) being able to project to the plane of the floor-engaging parts and being configured to move the movable strip from the first position to the second position in use, at least one second element also connected to the movable strip, the second element(s) being configured differently to the first element(s), the second element(s) being able to project to the plane of the floor-engaging parts and being configured to move the movable strip to a third position in use, the bottom edge of the movable strip being closer to the plane of the floor-engaging parts in its second position than in its third position.

2. The suction head according to claim 1 in which the first and second elements project below the bottom edge of the movable strip in its first position.

3. The suction head according to claim 2 in which the first and second elements project below the bottom edge of the movable strip in its first position by the same distance.

4. The suction head according to claim 1 in which the first and second elements project below the bottom edge of the movable strip in its first position by the same distance.

5. The suction head according to claim 1 in which the first element is oriented at a first angle relative to the movable strip, and the second element is oriented at a second angle relative to the movable strip, the first angle being less than the second angle.

6. The suction head according to claim 5 in which the first angle is less than 10°, and the second angle is between around 20° and around 45°.

7. The suction head according to claim 1 in which the first element is spaced from the plane of the floor-engaging parts in the third position.

8. The suction head according to claim 1 in which the bottom edge of the movable strip in its third position is spaced from the plane of the floor-engaging parts by around 10 mm.

9. The suction head according to claim 1 in which the first and second elements are configured to move the movable strip to its third position when the suction head is moving forwards, and to move the movable strip to its first position when the suction head is moving backwards.

10. The suction head according to claim 1 in which a unitary component comprising a fixed strip and the movable strip is located in the recess.

11. The suction head according to claim 10 in which the fixed strip and the movable strip are interconnected by a line of reduced material thickness.

12. The suction head according to claim 1 having a flexible strip behind the opening and further strips to the sides of the opening.

13. The suction head according to claim 1 having a resilient member projecting at the front end, a part of the resilient member being located above the recess, further parts of the resilient member being located at opposed sides of the recess.

14. The suction head according to claim 13 in which the resilient member is continuous.

15. The suction head according to claim 13 in which the resilient member lies immediately adjacent to the top and each of the sides of the recess.

16. The suction head according to claim 13 in which the front end has a planar surface, the resilient member being mounted to the planar surface.

17. The suction head according to claim 16 in which the resilient member terminates at a distance from the plane of the floor-engaging parts.

18. The suction head according to claim 17 in which the front end has a chamfered surface joined to the planar surface, the resilient member terminating at the junction of the planar and chamfered surfaces.

19. A method of operation of a vacuum cleaner having a suction head according to claim 1, the suction head being moved across a floor, the movable strip adopting its first position during backwards movement of the suction head and its third position during forwards movement of the suction head, the third position being reached in two stages, the first stage comprising the first element(s) engaging the floor surface and moving the movable strip towards its second position and also moving the second elements in a direction towards the floor, the second stage comprising the second element(s) engaging the floor and moving the movable strip to its third position.

20. The method of claim 19 in which there is an overlap between the first and second stages when the first element(s) and the second element(s) act together in moving the movable strip.

21. The method of claim 19 in which the second element(s) engage the floor when the movable strip is in its first position and are moved into greater engagement with the floor surface during the first stage.

22. The method of claim 19 in which the first element(s) move away from the floor during the second stage.

* * * * *